US007817815B2

(12) United States Patent
Miller

(10) Patent No.: US 7,817,815 B2
(45) Date of Patent: Oct. 19, 2010

(54) ARMATURE FOR A RECEIVER

(75) Inventor: Thomas E. Miller, Arlington Heights, IL (US)

(73) Assignee: Knowles Electronics, LLC, Itasca, IL (US)

( * ) Notice: Subject to any disclaimer, the term of this patent is extended or adjusted under 35 U.S.C. 154(b) by 1588 days.

(21) Appl. No.: 10/758,441

(22) Filed: Jan. 15, 2004

(65) Prior Publication Data

US 2004/0151340 A1 Aug. 5, 2004

Related U.S. Application Data

(63) Continuation-in-part of application No. 09/850,776, filed on May 8, 2001, now abandoned.

(51) Int. Cl.
*H04R 25/00* (2006.01)

(52) U.S. Cl. ..... 381/418; 381/322; 381/417; 381/324; 381/396; 381/191

(58) Field of Classification Search ..... 381/417, 381/418, 322, 324, 176
See application file for complete search history.

(56) References Cited

U.S. PATENT DOCUMENTS

| | | | | |
|---|---|---|---|---|
| 1,799,510 | A * | 4/1931 | Goldberg et al. | 132/284 |
| 3,002,058 | A | 9/1961 | Knowles | |
| 3,515,818 | A | 6/1970 | Tibbetts | |
| 3,588,383 | A | 6/1971 | Carlson et al. | |
| 3,617,653 | A * | 11/1971 | Tibbetts et al. | 310/36 |
| 3,935,398 | A * | 1/1976 | Carlson et al. | 381/386 |
| 4,002,863 | A | 1/1977 | Broersma | |
| 4,015,227 | A | 3/1977 | Riko et al. | |
| 4,109,116 | A | 8/1978 | Victoreen | |
| 4,272,654 | A | 6/1981 | Carlson | |
| 4,410,769 | A | 10/1983 | Tibbetts | |
| 4,473,722 | A | 9/1984 | Wilton | |
| 4,628,907 | A | 12/1986 | Epley | |
| 4,956,868 | A | 9/1990 | Carlson | |
| 5,068,901 | A | 11/1991 | Carlson | |
| 5,193,116 | A | 3/1993 | Mostardo | |
| 5,647,013 | A | 7/1997 | Salvage et al. | |
| 5,757,947 | A | 5/1998 | van Halteren et al. | |
| 5,809,158 | A | 9/1998 | van Halteren et al. | |
| 5,960,093 | A | 9/1999 | Miller | |

(Continued)

FOREIGN PATENT DOCUMENTS

| | | | |
|---|---|---|---|
| GB | 2 229 339 | A | 9/1990 |

(Continued)

OTHER PUBLICATIONS

International Search Report for Application No. PCT/US05/000875 dated May 20, 2005.

*Primary Examiner*—Wayne R Young
*Assistant Examiner*—Dionne H Pendleton
(74) *Attorney, Agent, or Firm*—Fitch, Even, Tabin & Flannery

(57) ABSTRACT

An armature for a receiver includes a first leg portion, a second leg portion, and a connection portion in communication with the first and second leg portions. The connection portion reduces the stiffness of the armature and minimizes magnetic reluctance of the connection between the first and second leg portions.

7 Claims, 9 Drawing Sheets

U.S. PATENT DOCUMENTS

| | | | |
|---|---|---|---|
| 6,041,131 | A | 3/2000 | Kirchhoefer et al. |
| 6,075,870 | A | 6/2000 | Geschiere et al. |
| 6,078,677 | A | 6/2000 | Dolleman et al. |
| 6,658,134 | B1 | 12/2003 | van Hal et al. |
| 2001/0022844 | A1 | 9/2001 | Urushibata et al. |
| 2002/0003890 | A1 | 1/2002 | Warren et al. |

FOREIGN PATENT DOCUMENTS

| | | | |
|---|---|---|---|
| WO | WO-01/87008 | A2 | 11/2001 |

* cited by examiner

FIG. 6
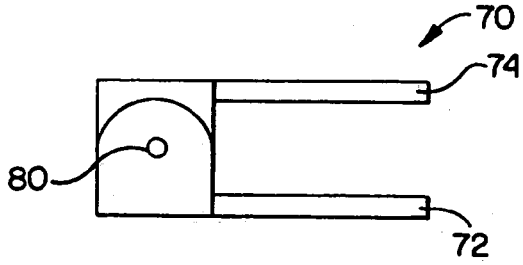
FIG. 7
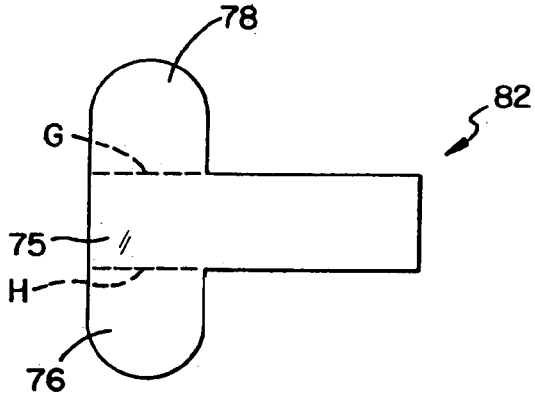
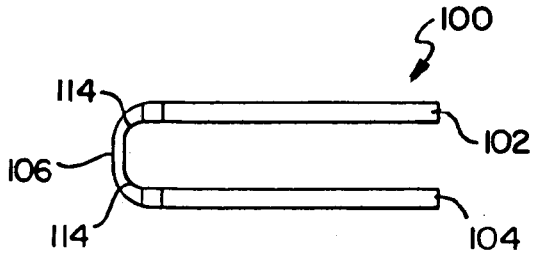
FIG. 8
FIG. 9
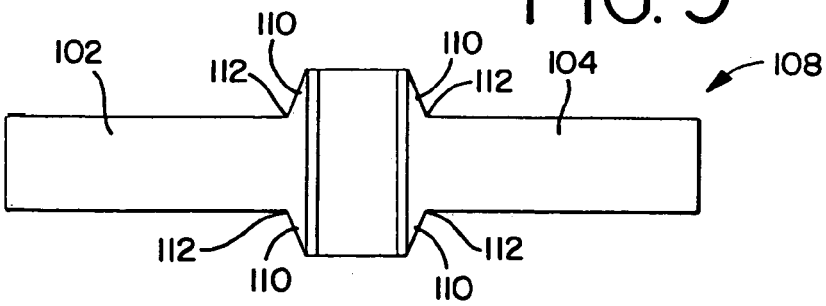
FIG. 10
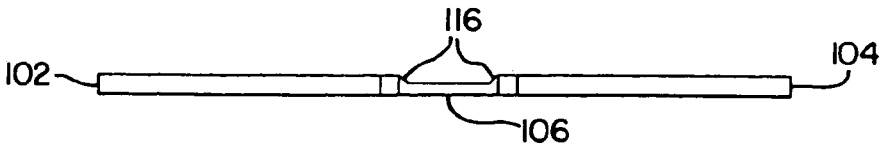

FIG. 11
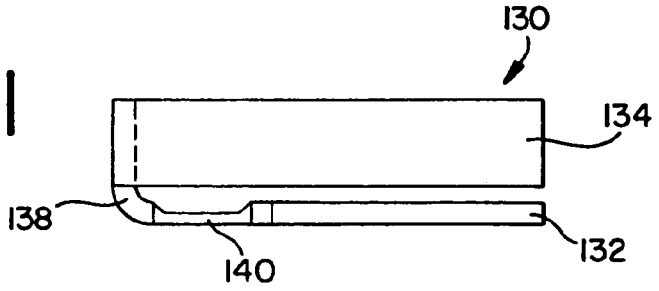
FIG. 12
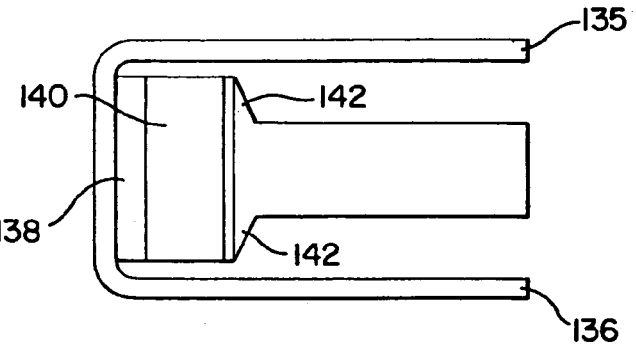
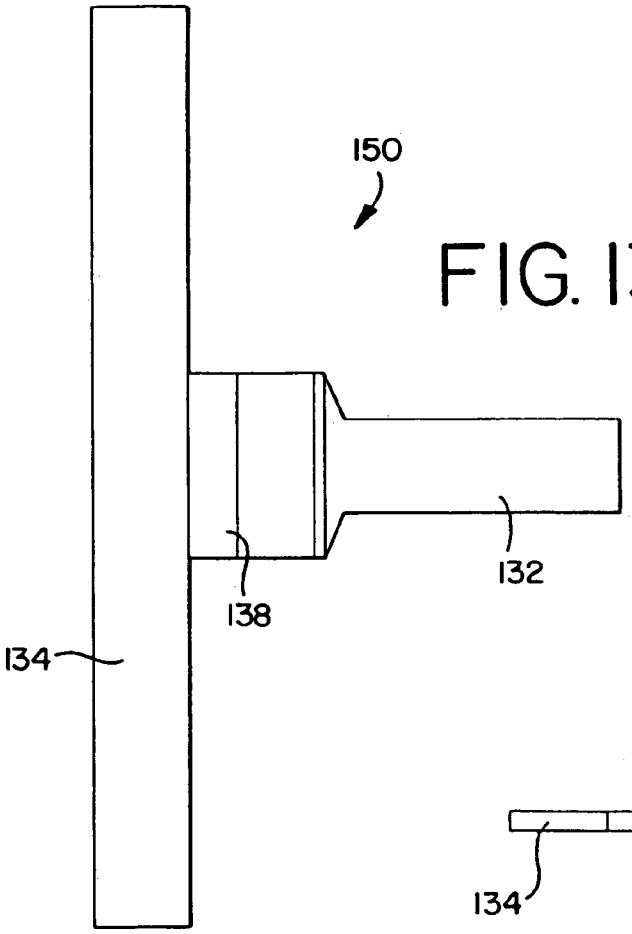
FIG. 13
FIG. 14
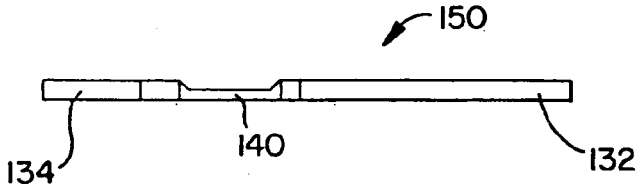

(PRIOR ART)

ARMATURE FOR A RECEIVER

CROSS-REFERENCES TO RELATED APPLICATIONS

This application is a continuation-in-part of U.S. patent application Ser. No. 09/850,776, entitled "Armature For a Receiver," filed May 8, 2001, which claims the benefit of U.S. Provisional Application No. 60/202,957, filed May 9, 2000, and U.S. Provisional Application No. 60/218,996, filed Jul. 17, 2000. These applications are incorporated by reference herein in their entireties for all purposes.

FIELD OF THE DISCLOSURE

The present disclosure generally relates to electroaccoustic receivers, and more particularly to armatures for use in electroaccoustic receivers.

BACKGROUND

FIG. 15 is a partially cut away side view of an integrated hearing aid receiver disclosed in U.S. Pat. No. 5,193,116. FIG. 16 is an end view of interior elements of the integrated receiver of FIG. 15, with the housing and upper structure removed. The hearing aid receiver 210 comprises a housing 212 having first and second outlet ports 214, 216, respectively. A diaphragm 218 is disposed within the housing 212, defining an output chamber 220 and a motor chamber 222. An armature 224 is disposed within the motor chamber 222 and has an operative element comprising a fixed end 239*a* and a movable end 228. The armature 224 is coupled by a link 230 to drive the diaphragm 218. A permanent magnet structure 232 having a central passage 234 surrounds the movable end 228 of the armature 224 and provides a permanent magnetic field within the passage 234. A drive coil 236 is disposed about the armature 224 and is located proximate to the permanent magnet structure 232. An amplifier 238 is disposed within the motor chamber 222 and between the armature 224 and the diaphragm 218.

The housing 212 is generally rectangular in cross-section, having. generally planar top 212*a*, bottom 212*b* and side walls 212*c*. The a armature 224 is configured as a generally U-shaped strap having first and second opposed legs 239*a*, 239*b*, respectively. The first leg 239*a* is adhesively secured to the housing wall of the motor chamber 222 opposite the diaphragm 218 by means of adhesive 240.

The permanent magnet structure 232 comprises a stack of ferromagnetic laminations 242, each having an aligned central lamination aperture 244. A pair of permanent magnets 246, 248 are disposed within the lamination apertures 244 and cemented to opposite faces thereof. The lower faces of the laminations 242 are welded to the right most end of the fixed leg 239*a* of the armature 224. This serves to complete the magnetic circuit around the armature loop.

As will be noted from FIG. 16, the second leg 239*b* of the armature 224 is narrower than the first leg 239*a*. The second leg 239*b* terminates in the movable end 228 of the armature 224.

In operation, excitation of the drive coil 236 magnetizes the armature 224. Interaction of the armature movable end 228 with the magnetic field causes the armature movable end 228 to vibrate. Movement of the coupled diaphragm 218 produces sound in the output chamber 220, which passes to the outlet port 214 through a passage 250.

Other examples of transducers suitable for use in hearing aids are disclosed in U.S. Pat. Nos. 3,588,383, 4,272,654, and 5,193,116, which are incorporated by reference herein.

The sound pressure output of a receiver such as the receiver described above is created by the travel, or deflection, of an armature of the receiver when the armature vibrates. Maximum deflection of the moving armature creates maximum sound pressure output for a given armature geometry. The maximum deflection of an armature is limited by the magnetic saturation of the armature, which is governed by the maximum magnetic flux that can pass through the armature geometry. Therefore, one way to increase the sound pressure output is to increase the magnetic flux that can pass through the armature.

The magnetic flux is limited by material type and cross-sectional area of the armature. Thus, if the thickness of the armature is increased, the maximum magnetic flux that can pass through the armature geometry is increased. Increasing the thickness of the armature, however, also increases the stiffness of the armature and tends to reduce the maximum deflection of the armature. Thus, merely increasing the thickness of the armature does not provide a significant improvement in the maximum deflection of the armature.

BRIEF DESCRIPTION OF THE DRAWINGS

FIG. 6 is an elevational side view of a third embodiment of a two-piece armature assembly of the present invention;

FIG. 7 is a top plan view of a first preform used to form a first leg of the armature assembly shown in FIG. 6;

FIG. 8 is an elevational side view of a one-piece armature according to the present invention;

FIG. 9 is a top plan view of a blank used to form the one-piece armature shown in FIG. 8;

FIG. 10 is an elevational side view of the blank shown in FIG. 9;

FIG. 11 is an elevational side view of a one-piece E-shaped armature according to the present invention;

FIG. 12 is a top plan view of the E-shaped armature shown in FIG. 11;

FIG. 13 is a top plan view of a blank used to form the one-piece E-shaped armature shown in FIG. 11;

FIG. 14 is an elevational side view of the blank shown in FIG. 13;

DETAILED DESCRIPTION

In one embodiment, an armature for a receiver is provided, the armature comprising a first and a second leg portion each having a thickness and a width and connected to each other, and a connection portion in communication with the first and second leg portions. The connection portion has a width greater than the width of the first and second leg portions individually. The connection portion reduces the stiffness of the armature and minimizes magnetic reluctance of the connection between the first and second leg portions. According to one aspect of the invention, the first and second leg portions are integrally formed with the connection portion and the connection portion includes at least a portion having a thickness less than the thickness of the first and second leg portions individually to reduce the stiffness of the armature. According to another aspect of the invention, the first and second leg portions are separately formed and attached to the connection portion in a way that reduces the stiffness of the armature.

Figure 1:
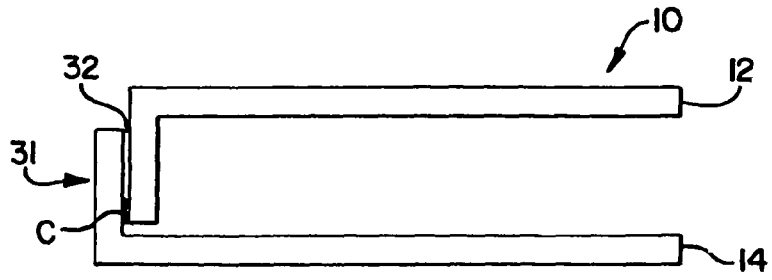
FIG. 1 is an elevational side view of a first embodiment of a two-piece armature assembly according to the present invention.
Figure 2:
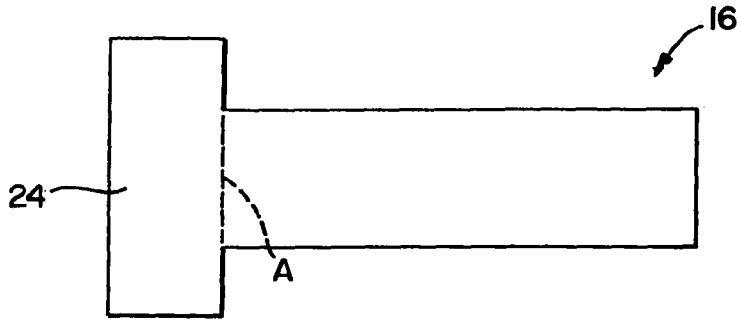
FIG. 2 is a top plan view of a first preform used to form a first leg of the armature assembly shown in FIG. 1.
Figure 3:
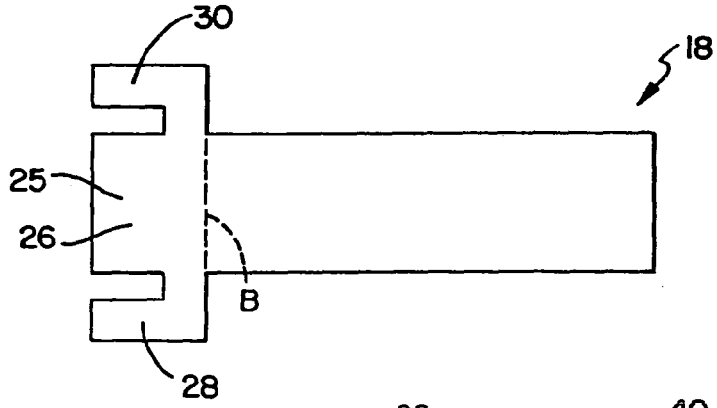
FIG. 3 is a top plan view of a second preform used to form a second leg of the armature assembly shown in FIG. 1.

FIG. 1 illustrates a first embodiment of a two-piece armature assembly 10. The armature assembly 10 comprises a first leg portion 12 and a second leg portion 14. FIG. 2 shows a preform 16 used to form the first leg portion 12. FIG. 3 shows a second preform 18 used to form the second leg portion 14. The leg portions 12 and 14 are formed by bending the preforms 16 and 18 along bend lines A and B, respectively. The bend lines A and B are merely reference lines for purposes of illustrating the line along which the preforms 16 and 18 are bent and are not formed on the preforms 16 and 18. However, in an alternate embodiment, the preforms 16 and 18 may be provided with a score line or other means (not shown) to aid in the bending of the preforms 16 and 18.

The first leg portion 12 includes a connection region or segment 24, as shown in FIG. 2. The second leg portion 14 includes a connection region or segment 25. The connection segment 25 includes a magnetic keeper region 26 and integrally formed connecting straps 28 and 30 disposed adjacent to the magnetic keeper region 26, as shown in FIG. 3. The connecting straps 28 and 30 provide a surface for the second leg portion 14 to be attached to the first leg portion 12, as shown in FIG. 1. Alternatively, the connecting straps 28 and 30 can be integrally formed with the first leg portion 12. Furthermore, the connecting straps 28 and 30 may be fabricated as separate pieces and mechanically connected to either or both of the leg portions 12 and 14. In a preferred embodiment, the first and second leg portions are welded together.

When the first and second leg portions 12 and 14 are assembled, a connection portion 31 is formed, as shown in FIG. 1. Within the connection portion 31, the connection segment 24 of the first leg portion 12 and the magnetic keeper region 26 of the connection segment 25 of the second leg portion 14 , overlap and define a gap 32 therebetween, as shown in FIG. 1. The gap 32 provides clearance between the two leg portions 12 and 14 to allow adequate deflection of one of the leg portions 12 and 14 with respect to the other. Preferably, the first leg portion 12 is fixed relative to the second leg portion 14. Preferably, the leg portions 12 and 14 are fixed by a weld C disposed between the connecting straps 28 and 30 of the connection segment 25 and the connection segment 24, as shown in FIG. 1. Preferably, the weld between the connecting straps 28 and 30 of the connection segment 25 of the second leg portion 14 and the connection segment 24 of the first leg portion 12 is a contact weld. However, any type of weld well known in the metal fabrication arts can be used. To insure that a gap is formed between the connection segment 24 and the magnetic keeper region 26 of the connection segment 25, either segment 24, region 26 or the connecting straps 28 and 30 may be punched or swaged to form a bump or other raised portion (not shown) that acts as a standoff between the segment 24 and the region 26 of the segment 25.

The overlapping segment 24 and region 26 of the segment 25 have a large enough surface area to minimize the magnetic reluctance between the two leg portions 12 and 14. This allows maximum magnetic flux to pass through the armature assembly 10. The gap 32 can be sized to accommodate the maximum deflection of one of the leg portions 12 and 14 for a maximum flux defined by armature assembly 10.

Figure 4:
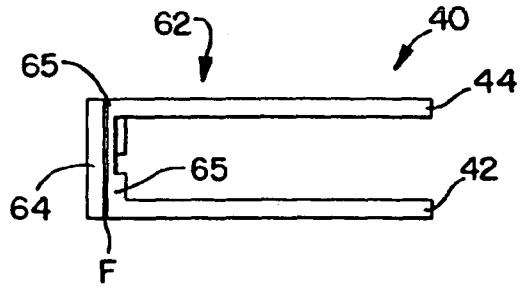
FIG. 4 is a side elevational view of a second embodiment of a two-piece armature assembly of the present invention.
Figure 5:
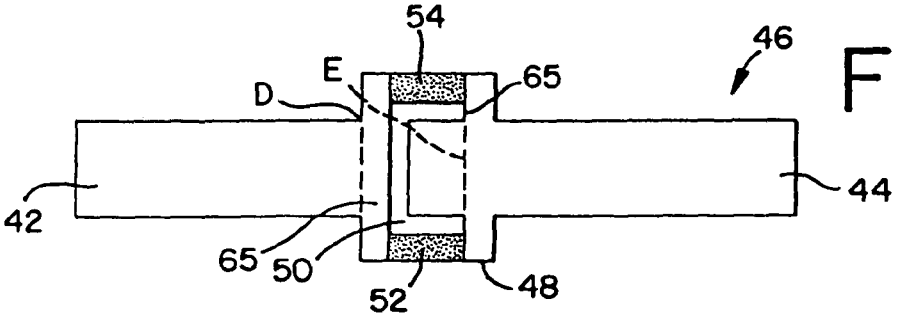
FIG. 5 is a top plan view of a preform used to form a leg portion of the armature assembly shown in FIG. 4.

FIG. 4 illustrates an alternate embodiment armature assembly 40. In this embodiment, a first leg portion 42 and a second leg portion 44 are integrally formed from a single preform 46, as shown in FIG. 5. The preform 46 includes a central connection portion 48 having a cutout 50 defining connection legs 52 and 54 and a magnetic keeper region 56. The connection legs 52 and 54 are etched or machined to be thinner than the thickness of the remaining portions of the preform 46. This reduces the stiffness of the connection legs 52 and 54 with respect to the remaining portions of the preform 46. The preform 46 is bent along bend lines D and E to form an armature leg portion 62 of the armature assembly 40, as shown in FIG. 4. In a preferred embodiment, the connection portion 48 includes a generally flat cover portion 64 that is attached to one or more other portions 65 of the connection portion 48 to complete the armature assembly 40, as shown in FIG. 4. Preferably, the cover portion 64 is welded at a weld F. The cover portion 64 provides a large surface area that overlaps and interacts with the magnetic keeper region 56 to minimize the magnetic reluctance between the first and second leg portions 42 and 44. As with the first embodiment, a raised portion (not shown) can be provided on the cover portion 64 of the connection portion 48 to act as a standoff between the cover portion 64 and the other portions 65 and the keeper region 56 of the connection portion 48.

FIG. 6 illustrates an alternate embodiment two-piece armature assembly 70. In this embodiment, the armature assembly 70 includes a first leg portion 72 and a second leg portion 74. FIG. 7 generically depicts a preform 82 used to form the leg portions 72 and 74 of the armature assembly 70. Each of the leg portions 72 and 74 include a connection segment 75 having two connection flaps or tabs 76 and 78 that accommodate attachment of the leg portions 72 and 74 to each other. When the leg portions are attached, a connection portion 79 is formed, as shown in FIG. 6. In a preferred embodiment, the leg portions 72 and 74 are connected via a snap fit. The connection flaps 76 and 78 are bent along bend lines G and H and can be punched to form either holes or dimples to facilitate connection with a second set of connection tabs. One pair of connection tabs 76 and 78 can be provided with holes and the other pair can be provided with dimples or other raised portions (not shown) that snap fit within the holes at a connection point 80, as shown in FIG. 6. Since this embodiment has no inherent centering as in the previously described embodiments, a spring (not shown) can be provided between the two leg portions 72 and 74 to facilitate deflection of the leg portions 72 and 74 with respect to each other. The connection tabs 76 and 78 of one of the leg portions 72 and 74 will be spaced farther apart from each other to allow the connection tabs 76 and 78 of the other of the leg portions 72 and 74 to fit therebetween, as shown in FIG. 6.

FIG. 8 illustrates a one-piece armature 100 of the present invention. The armature 100 is generally U-shaped and comprises a first leg portion 102 and a second leg portion 104 that are offset by a connection portion 106 disposed generally perpendicularly therebetween. The first and second leg portions 102 and 104 are generally flat and are disposed such that they are generally parallel to each other.

The first and second leg portions 102 and 104 and the connection portion 106 are integrally formed from a blank 108, as shown in FIG. 9. The blank 108 is made of a metallic material having good magnetic permeability that can be fabricated and formed through conventional metal fabrication and forming techniques that are well known in the art. The connection portion 106 is wider than the first and second leg portions 102 and 104, as shown in FIG. 9, but has a material thickness that is less than the first and second leg portions 102 and 104, as shown in FIG. 10. The connection portion 106 also includes angled portions 110 integrally formed between the connection portion 106 and the first and second leg portions 102 and 104. The angled portions 110 help to guide the magnetic flux from the wide connection portion 106 to the narrower leg portions 102 and 104. The angled portions 110 also help reduce the material stresses that would normally be concentrated at corners 112, during and after fabrication, if those comers were positioned along bends 114 of the armature 100, as shown in FIG. 8. Additionally, the connecting portion includes tapered portions 116 that reduce material stresses along the bends 114 of the armature 100, as shown in FIG. 10. The tapered portions 116 reduce the material stresses normally associated with sharp corner bends in metal fabrication.

The reduced material thickness of the connection portion 106 reduces the stiffness of the connection portion 106 while the greater width of the connecting portion 106 compensates for the increased magnetic flux density that would be associated with the decreased cross-sectional area of the connection portion 106 due to the reduced material thickness. Thus, the additional cross-sectional area associated with the wider connection portion 106 minimizes the magnetic flux density of the connection portion 106, which allows the magnetically permeable material of the armature 100 to be able to perform at higher receiver drive levels.

In a preferred embodiment, the connection portion 106 is half as thick and twice as wide as the first and second leg portions 102 and 104. This configuration keeps the cross-sectional area constant throughout the armature 100, thereby preserving the armature's ability to carry magnetic flux. Furthermore, the increased width of the connection portion 106 in this configuration does not increase the stiffness of the connection portion 106, since material stiffness is a function of the cube of the material thickness while only proportional to the width of the material.

The reduced stiffness of the connection portion 106, combined with its increased width, allows maximum magnetic flux to pass through the connection portion 106, as well as the first and second leg portions 102 and 104, while allowing maximum deflection between the first and second leg portions 102 and 104 for maximum output sound pressure of a receiver incorporating the armature 100.

FIG. 11 shows an alternate embodiment in the form of an E-shaped armature 130. The armature 130 includes a generally flat first leg portion 132 and a generally flat second leg portion 134. The second leg portion 134 has two legs 135 and 136 disposed generally transverse to the first leg portion 132, as shown in FIG. 12. The first leg portion 132 is disposed between the two legs 135 and 136 as shown in FIG. 12 and below the two legs 135 and 136 as shown in FIG. 11. A connection portion 138 is in communication with the first and second leg portions 132 and 134, as shown in FIGS. 11 and 12. The connection portion 138 includes a portion 140 having a material thickness that is less than the other portions of the armature 130. The reduced material thickness is best shown in FIG. 11. As shown in FIG. 12, the connection portion 138 includes angled portions 142 integrally formed between the portion 140 and the first leg portion 132, which is narrower than the portion 140. The angled portions 142 help to guide the magnetic flux from the portion 140 of the connection portion 138 to the narrower first leg portion 132.

The E-shaped armature 130 is formed from a blank 150, as shown in FIG. 13 and FIG. 14. The blank 150 is made of a metallic material having good magnetic permeability that can be fabricated and formed through conventional metal fabrication and forming techniques that are well known in the art.

The reduced material thickness of the portion 140 reduces its stiffness. This allows for an increased deflection of the first leg portion 132 with respect to the legs 135 and 136 of the second leg portion 134. The greater width of the connection portion 138 compensates for the increased magnetic flux density that would normally be associated with the decreased cross-sectional area of the portion 140 of the connection portion 138 due to the reduced material thickness without an increase in width. Thus, the additional cross-sectional area associated with the greater width minimizes the magnetic flux density associated with portion 140, which allows the magnetically permeable material of the armature 130 to be able to perform at higher receiver drive levels.

In one embodiment of an armature for a receiver, the armature comprises a first leg portion having a thickness and a width, and a second leg portion spaced apart from the first leg portion. The armature also comprises a connection portion to flexibly couple the first leg portion with the second leg portion. The connection portion includes a reduced thickness portion having a thickness less than the thickness of the first leg portion. Additionally, a width of the connection portion is greater than the width of the first leg portion.

In another embodiment of an armature for a receiver, the armature comprises a first leg portion having a thickness and a width. The armature also comprises a second leg portion spaced apart from the first leg portion, and a third leg. portion spaced apart from the first leg portion and spaced apart from the second leg portion. The armature further comprises a connection portion to flexibly couple the first leg portion with the second portion and with the third leg portion. The connection portion includes a reduced thickness portion having a thickness less than the thickness of the first leg portion. Additionally, a width of the connection portion is greater than the width of the first leg portion.

In still another embodiment of an armature for a receiver, the armature comprises a first leg portion and a second leg portion spaced apart from the first leg portion. The armature additionally comprises a first connection segment connected to the first leg portion, and a second connection segment in magnetic communication with the second leg portion. At least a portion of the second connection segment is spaced apart from, and overlaps with, at least a portion of the first connection segment. The armatures also comprises a plurality of connection legs to flexibly couple the first leg portion to the second leg portion, wherein at least one of the connection legs is spaced apart from at least another of the connection legs.

Figure 15:
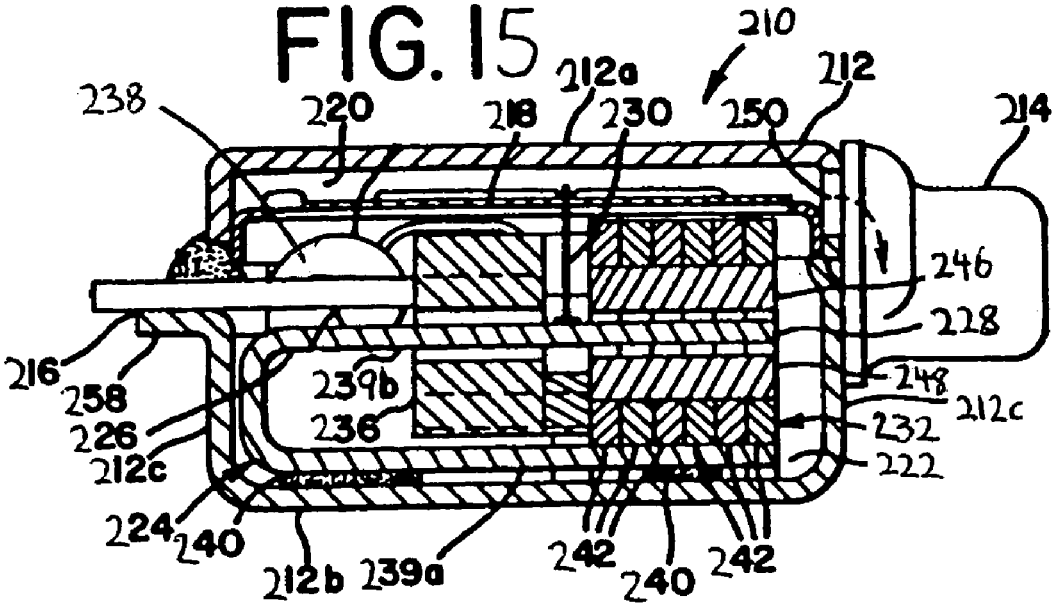
FIG. 15 is a partially cut-away side view of a prior art integrated hearing aid receiver.
Figure 16:
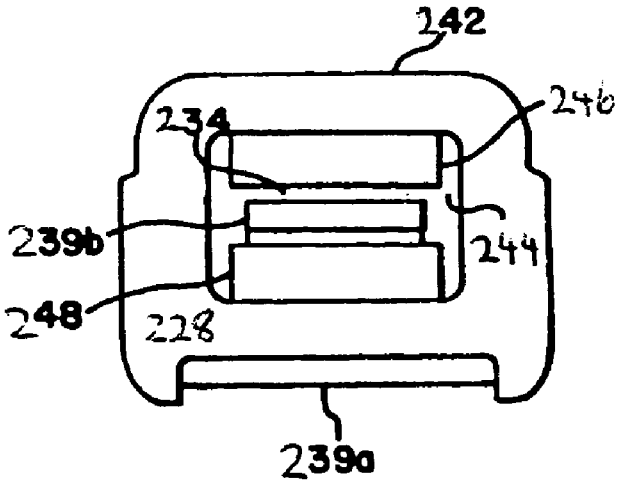
(PRIOR ART) FIG. 16
FIG. 16 is an end view of interior elements of the integrated receiver of FIG. 15.
Figure 17A:
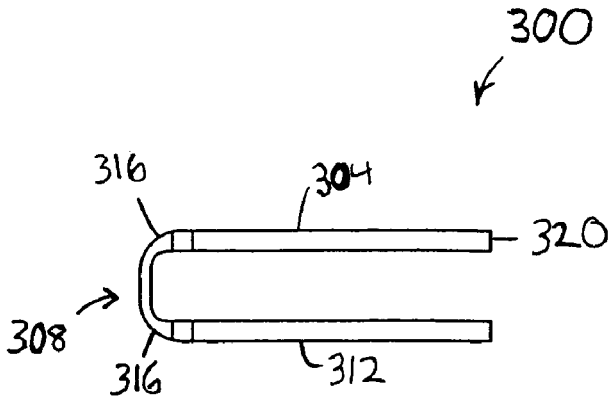
FIG. 17A is a side view of an example armature.

FIG. 17A is a side view of an example armature 300 that can be used in a variety of receivers, including receivers similar to the receiver 210 illustrated in FIGS. 15 and 16. The armature 300 includes a first leg portion 304, a connection portion 308, and a second leg portion 312. The connection portion 308 includes bended portions 316. The first leg portion 304 and the second leg portion 312 are spaced apart and are substantially parallel to one another, and the connection portion 308 is generally perpendicular to the first leg portion 304 and the second leg portion 312.

The first leg portion 304 may be disposed within a drive coil and between permanent magnets of the receiver, for example. The second leg portion 312 may be coupled to a housing and/or a yoke (or stack) of the receiver, for example. An end 320 of the first leg portion 304 may be free to vibrate.

Figure 17B:
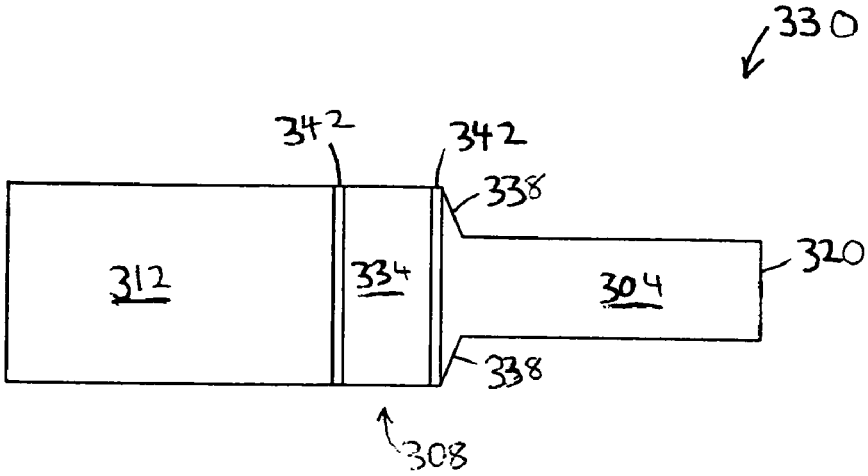
FIG. 17B is a top view of an example preform from which the armature of FIG. 17A may be formed.
Figure 17C:
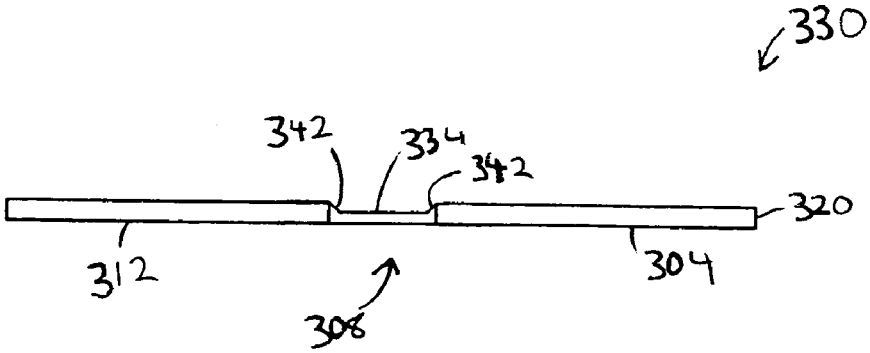
FIG. 17C is a side view of the preform of FIG. 17B.

FIGS. 17B and 17C are illustrations of an example preform 330 from which the armature 300 of FIG. 17A may be formed. In particular, FIG. 17B is a top view of the preform 330, and FIG. 17C is a side view of the preform 330. The preform 330 comprises a metallic material having an appropriate magnetic permeability and that can be fabricated and formed, for example, through conventional metal fabrication and forming techniques that are well known to those of ordinary skill in the art.

The preform 330 includes the first leg portion 304, the connection portion 308, and the second leg portion 312. A width of the first leg portion 304 is appropriate for being disposed within a drive coil and between permanent magnets of the receiver, for example. A width of the connection portion 308 is greater than the width of the first leg portion 304. Additionally, as can be seen in FIG. 17C, a reduced thickness portion 334 of the connection portion 308 has a thickness less than a thickness of the first leg portion 304. A width of the second leg portion 312 may be substantially the same as the connection portion 308, and a thickness of the second leg portion 312 may be substantially the same as the thickness of the first leg portion 304.

In one example, the thickness of the reduced thickness portion 334 is approximately 50% of the thickness of the first leg portion 304, and the width of the connection portion 308 is approximately twice that of the first leg portion 304. Thus, in this example, the cross sectional area of the reduced thickness portion 334 is approximately the same as the cross sectional area of the first leg portion 304. Because material stiffness is a function of the cube of the thickness while only proportional to the width of the material, the armature 300 is less stiff than an armature such as the armature 224 of FIG. 15. Additionally, even though the thickness of the reduced thickness portion 334 is approximately 50% of the thickness of the first leg portion 304, the maximum magnetic flux that can pass through the armature 300 is not reduced because the smallest cross sectional area of the connection portion 308 is approximately the same as that of the first leg portion 304. Thus, the maximum deflection of the armature 300 is increased as compared to an armature such as the armature 224 of FIG. 15.

The connection portion 308 may include angled portions 338 integrally formed between the reduced thickness portion 334 and the first leg portion 304. The angled portions 338 help to guide magnetic flux between the reduced thickness portion 334 and the first leg portion 304. Further, the connection portion 308 includes tapered portions 342 that help reduce material stresses within the bended portions 316. Generally, the tapered portions 342 help reduce material stresses associated with sharp corner bends in metal fabrication.

It is to be understood that widths and thicknesses other than those described above may be utilized as well. For example, the reduced thickness portion 334 may be 30% to 90% of the thickness of the first leg portion 304. Similarly, the width of the first leg portion 304 may be 30% to 90% of the width of the connection portion 308, for example. Additionally, the width of the second leg portion 312 may be greater than the width of the connection portion 308. Further, a width of a portion of the second leg portion 312 may be at least the width of the connection portion 308, while a width of another portion of the second leg portion 312 may be greater than or less than the width of the connection portion 308. Still further, the thickness of the second leg portion 312 may be greater than or less than the thickness of the first leg portion 304.

Figure 18A:
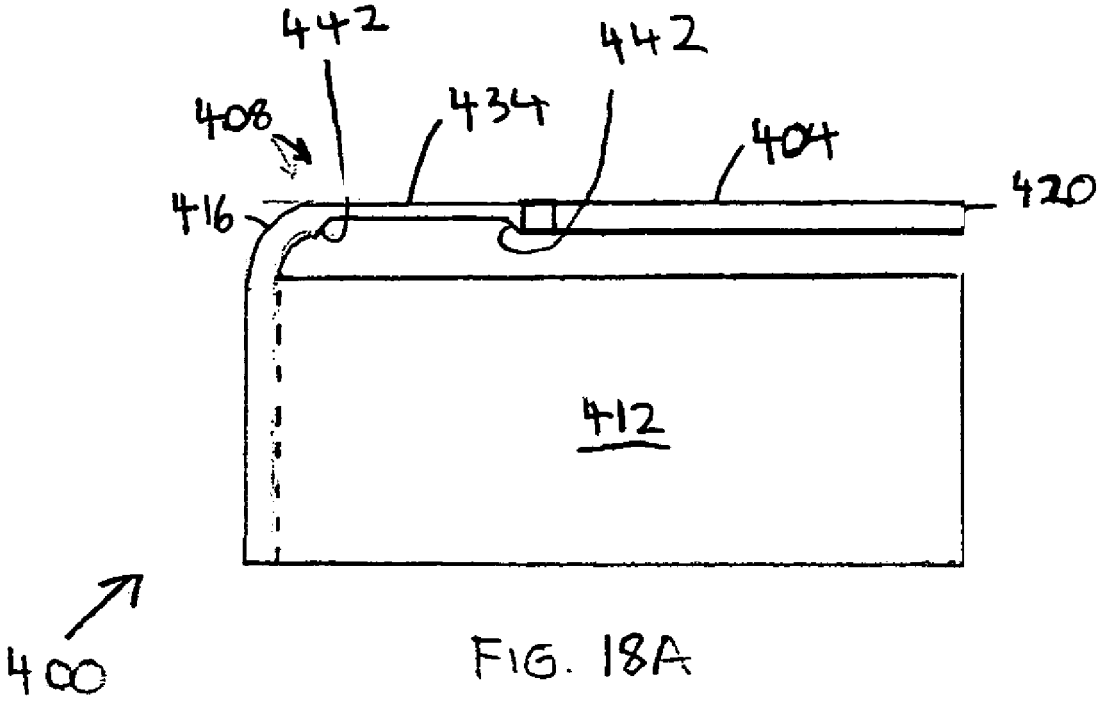
FIG. 18A is a side view of another example armature.
Figure 18B:
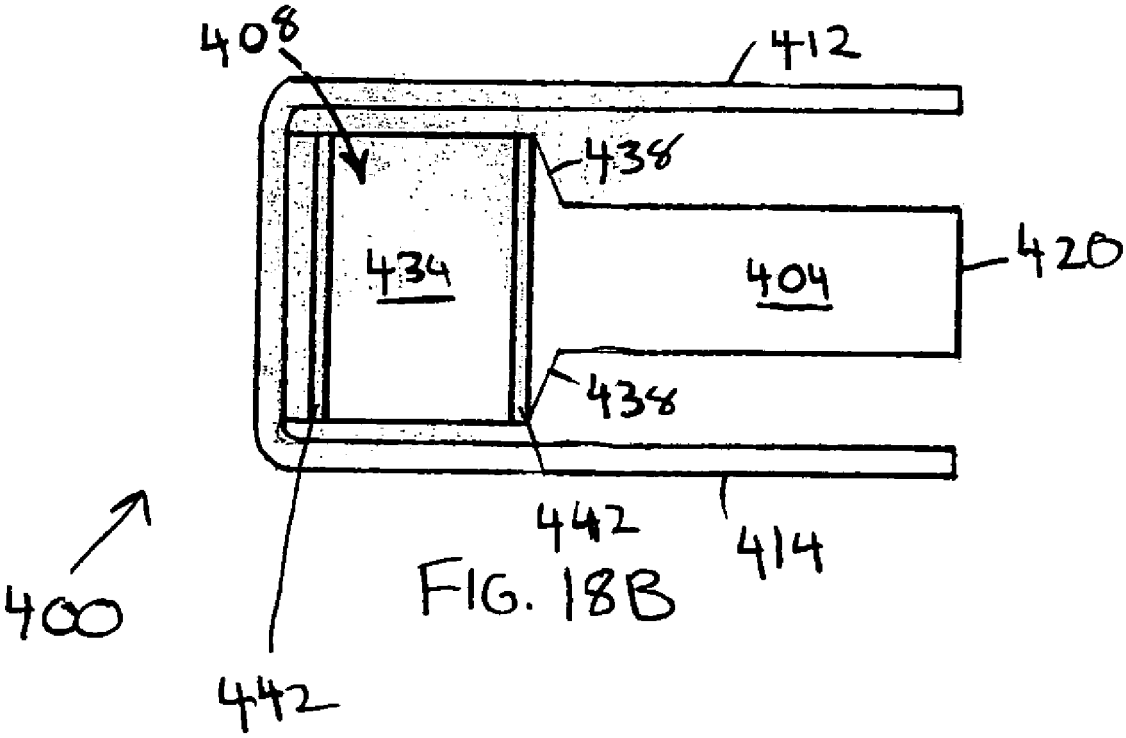
FIG. 18B is a top view of the example armature of FIG. 18A.

FIG. 18A is a side view and FIG. 18B is a bottom view of another example armature 400 that can be used in a variety of receivers, including receivers similar to the receiver 210 illustrated in FIGS. 15 and 16. The armature 400 includes a first leg portion 404, a connection portion 408, a second leg portion 412, and a third leg portion 414. The connection portion 408 includes bended portion 416. The first leg portion 404 is spaced apart from the second leg portion 412 and the third leg portion 414. The second leg portion 412 and the third leg portion 414 are spaced apart and are substantially parallel to one another. The connection portion 408 is generally parallel to the first leg portion 404, and generally transverse to the second leg portion 412 and the third leg portion 414.

The first leg portion 404 may be disposed within a drive coil and between permanent magnets of the receiver, for example. The second leg portion 412 and the third leg portion 414 may be coupled to a housing and/or a yoke (or stack) of the receiver, for example. An end 420 of the first leg portion 404 may be free to vibrate.

Figure 18C:
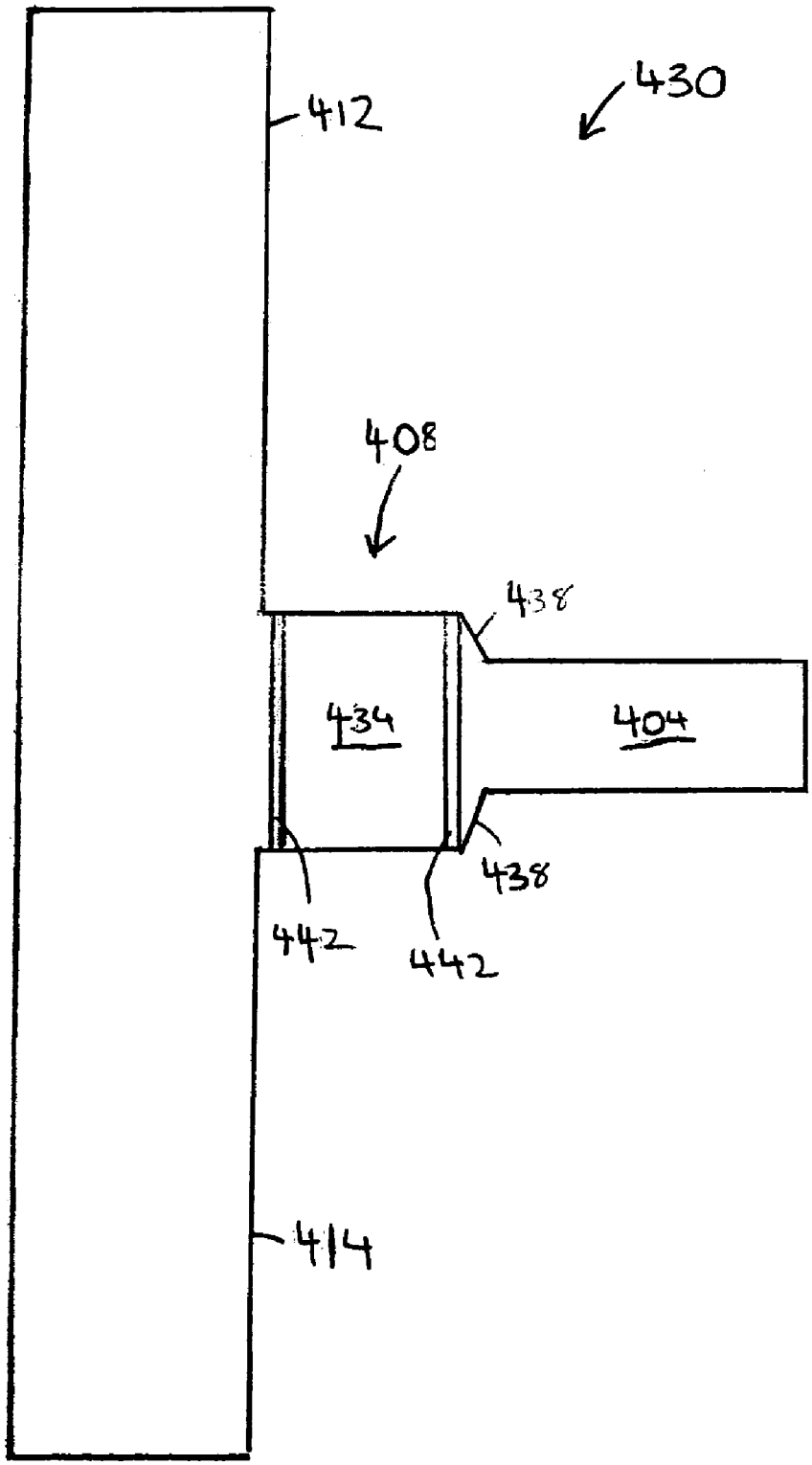
FIG. 18C is an example preform from which the armature of FIGS. 18A and 18B may be formed.

FIG. 18C is an illustration of an example preform 430 from which the armature 400 of FIGS. 18A and 18B may be formed. The preform 430 may comprise a metallic material having an appropriate magnetic permeability and that can be fabricated and formed, for example, through conventional metal fabrication and forming techniques that are well known to those of ordinary skill in the art.

The preform 430 includes the first leg portion 404, the connection portion 408, the second leg portion 412, and the third leg portion 414. A width of the first leg portion 404 is appropriate for being disposed within a drive coil and between permanent magnets of the receiver, for example. A width of the connection portion 408 is greater than the width of the first leg portion 404. Additionally, as can be seen in FIG. 18A, a reduced thickness portion 434 of the connection portion 408 has a thickness less than a thickness of the first leg portion 404. A width of the second leg portion 412 is substantially the same as the width of the connection portion 408, and a width of the third leg portion 414 is substantially the same as the width of the connection portion 408. Additionally, a thickness of the second leg portion 412 is substantially the same as the thickness of the first leg portion 404, and a thickness of the third leg portion 414 is substantially the same as the thickness of the first leg portion 404.

In one example, the thickness of the reduced thickness portion 434 is approximately 50% of the thickness of the first leg portion 404, and the width of the connection portion 408 is approximately twice that of the first leg portion 404. Thus, the cross sectional area of the reduced thickness portion 434 is approximately the same as the cross sectional area of the first leg portion 404. Because material stiffness is a function of the cube of the thickness while only proportional to the width of the material, the armature 400 is less stiff than an armature such as the armature 224 of FIG. 15. Additionally, even though the thickness of the reduced thickness portion 434 is approximately 50% of the thickness of the first leg portion 404, the maximum magnetic flux that can pass through the armature 400 is not reduced because the smallest cross sectional area of the connection portion 408 is approximately the same as that of the first leg portion 404. Thus, the maximum deflection of the armature 400 is increased as compared to an armature such as the armature 224 of FIG. 15.

The connection portion 408 may include angled portions 438 integrally formed between the reduced thickness portion 434 and the first leg portion 404. The angled portions 438 help to guide magnetic flux between the reduced thickness portion 434 and the first leg portion 404. Further, the connection portion 408 may include one or more tapered portions 442 that help reduce material stresses within the bended portions 416. Generally, the tapered portions 442 help reduce material stresses associated with sharp corner bends in metal fabrication.

It is to be understood that widths and thicknesses other than those described above may be utilized as well. As one example, the reduced thickness portion 434 may be 30% to 90% of the thickness of the first leg portion 404. Similarly, the width of the first leg portion 404 may be 30% to 90% of the width of the connection portion 408, for example. Additionally, the width of the second leg portion 412 and/or the width of the third leg portion 414 may be greater than the width of the connection portion 408. Further, a width of a portion of the second leg portion 412 and/or a width of a portion of the third leg portion 414 may be at least the width of the connection portion 408, while a width of another portion of the second leg portion 412 and/or a width of another portion of the third leg portion 414 may be greater than or less than the width of the connection portion 408. Still further, the thickness of the second leg portion 412 may be greater than or less than the thickness of the first leg portion 404. Similarly, the thickness of the third leg portion 414 may be greater than or less than the thickness of the first leg portion 404.

Figure 19B:
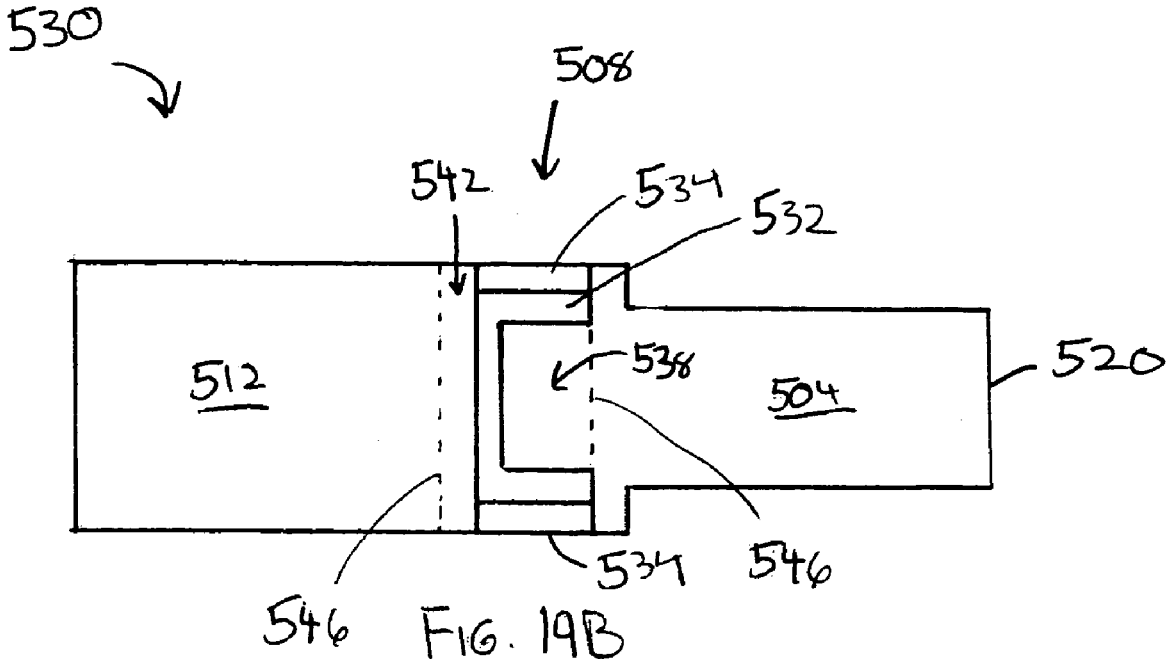
FIG. 19B is a top view of an example preform from which the armature of FIG. 19A may be formed.
Figure 19A:
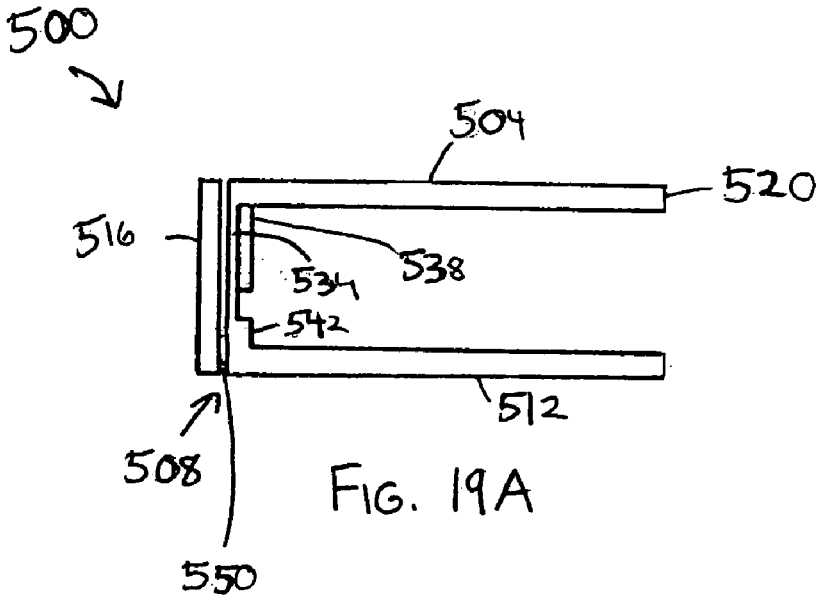
FIG. 19A is a side view of yet another example armature.

FIG. 19A is a side view of yet another example armature 500 that can be used in a variety of receivers, including receivers similar to the receiver 210 illustrated in FIGS. 15 and 16. The armature 500 includes a first leg portion 504, a connection portion 508, and a second leg portion 512. The connection portion 508 includes a cover 516. The first leg portion 504 and the second leg portion 512 are spaced apart and are substantially parallel to one another, and the connection portion 508 is generally perpendicular to the first leg portion 504 and the second leg portion 512.

The first leg portion 504 may be disposed within a drive coil and between permanent magnets of the receiver, for example. The second leg portion 512 may be coupled to a housing and/or a yoke (or stack) of the receiver, for example. An end 520 of the first leg portion 504 may be free to vibrate.

FIG. 19B is an illustration of an example preform 530 from which the armature 500 of FIG. 19A may be formed, except for the cover portion 516. The preform 530 may comprise a metallic material having an appropriate magnetic permeability and that can be fabricated and formed, for example, through conventional metal fabrication and forming techniques that are well known to those of ordinary skill in the art.

The preform 530 includes the first leg portion 504, the connection portion 508, and the second leg portion 512. A width of the first leg portion 504 is appropriate for being disposed within a drive coil and between permanent magnets of the receiver, for example. A width of the connection portion 508 is greater than the width of the first leg portion 504.

The connection portion comprises a cutout 532 that defines connection legs 534, a first region 538, and a second region 542. As can be seen in FIG. 19A, a thickness of the connection legs 534 is less than a thickness of the first leg portion 504. The first region 538 is connected to the first leg portion 504 and the second region 542 is connected to the second leg portion 512. The preform 530 may be bent along bend lines 546 to form the armature 500.

Referring now to FIGS. 19A and 19B, the cover 516 is spaced apart from the connection legs 534 and the first region 538, and is connected to the second region 542. For example, the cover 516 may be connected to the second region 542 via one or more welds 550 (e.g., a contact weld or another suitable type of weld). Additionally, the cover 516 overlaps the first region 538 and the second region 542. Optionally, the cover 516 may also overlap one or more of the connection legs 534. The cover 516 may include a standoff, a bump, etc., adjacent to the second region 542 to space apart the cover 516 from the first region 538 and, if the cover 516 overlaps one or more of the connection legs 534, to space apart the cover 516 from the connection legs 534. A standoff, a bump, etc., may additionally or alternatively be included on the second region 542.

The connection legs 534 flexibly couple the first leg portion 504 to the second leg portion 512. Because the connection legs 534 have a cumulative width which is less than the width of the first leg portion 504, and because the connection legs 534 have a thickness less than the thickness of the first leg portion 504, the armature 500 is less stiff than an armature such as the armature 224 of FIG. 15. On the other hand, the cumulative cross sectional area of the connection legs 534 is less than the cross sectional area of the first leg portion 504. Alone, this would tend to reduce the maximum magnetic flux that can pass through the armature 500.

The overlap, however, between the cover 516 and the first region 538 and between the cover 516 and the second region 542 provides an additional path through which magnetic flux may pass. This helps to compensate for the reduced cross sectional area of the connection legs 534. Thus, the maximum deflection of the armature 300 is increased as compared to an armature such as the armature 224 of FIG. 15.

As merely one example, the thickness of the connection legs 534 may be 30% to 90% of the thickness of the first leg portion 304. Also, the cumulative width of the connection legs 534 may be 5% to 30% of the width of the first leg portion, for example. Additionally, the width of the first leg portion 504 may be 30% to 90% of the width of the connection portion 508, for example.

Additionally, the width of the second leg portion 512 may be greater than the width of the connection portion 508. Further, a width of a portion of the second leg portion 512 may be at least the width of the connection portion 508, while a width of another portion of the second leg portion 512 may be greater than or less than the width of the connection portion 508. Still further, the thickness of the second leg portion 512 may be greater than or less than the thickness of the first leg portion 504.

Figure 20A:
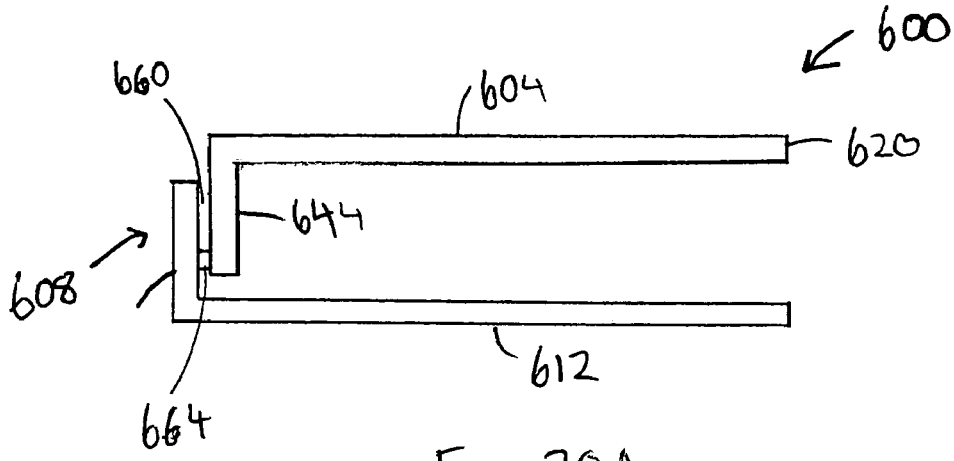
FIG. 20A is a side view of still another example armature.

FIG. 20A is a side view of an example armature 600 that can be used in a variety of receivers, including receivers similar to the receiver 210 illustrated in FIGS. 15 and 16. The armature 600 includes a first leg portion 604, a connection portion 608, and a second leg portion 612. The first leg portion 604 and the second leg portion 612 are spaced apart and are substantially parallel to one another, and the connection portion 608 is generally perpendicular to the first leg portion 604 and the second leg portion 612.

The first leg portion 604 may be disposed within a drive coil and between permanent magnets of the receiver, for example. The second leg portion 612 may be coupled to a housing and/or a yoke (or stack) of the receiver, for example. An end 620 of the first leg portion 604 may be free to vibrate.

Figure 20B:
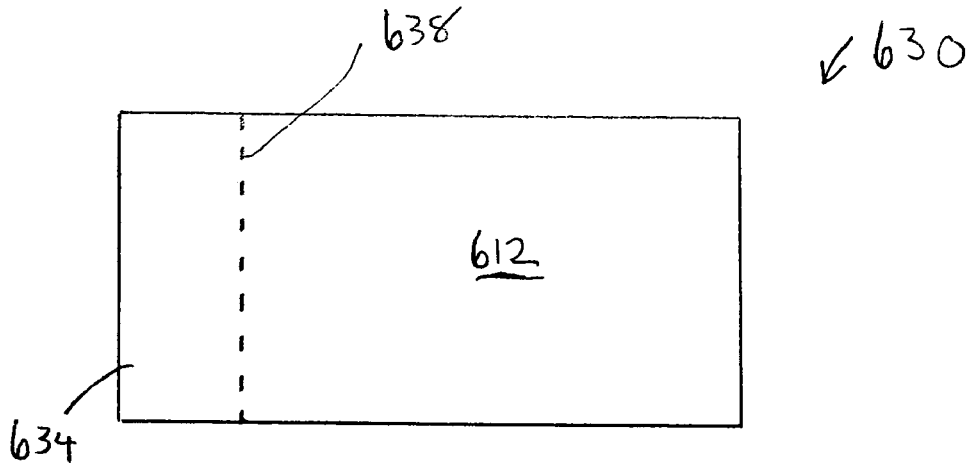
FIG. 20B is a top view of an example preform from which a portion of the armature of FIG. 20A may be formed.
Figure 20C:
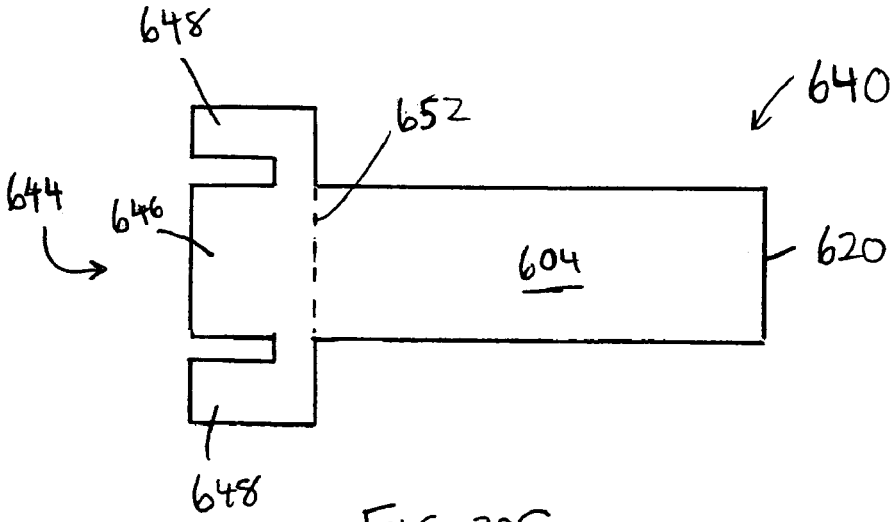
FIG. 20C is a top view of an example preform from which another portion of the armature of FIG. 20A may be formed.

FIGS. 20B and 20C are illustrations of example preforms 630 and 640, respectively, from which the armature 600 of FIG. 20A may be formed. In particular, FIGS. 20B and 20C are top views of the preforms 630 and 640. The preforms 630 and 640 may comprise a metallic material having an appropriate magnetic permeability and that can be fabricated and formed, for example, through conventional metal fabrication and forming techniques that are well known to those of ordinary skill in the art.

Referring now to FIG. 20B, the preform 630 includes the second leg portion 612 and a connection region 634. The preform 630 may be bent along bend line 638. Referring now to FIG. 20C, the preform 640 includes the first leg portion 604 and a connection region 644. The connection region 644 includes an overlap region 646 and connection legs 648. The preform 640 may be bent along the bend line 652.

A width of the first leg portion 604 is appropriate for being disposed within a drive coil and between permanent magnets of the receiver, for example. A width of the connection region 644 is greater than the width of the first leg portion 604. A width of the second leg portion 612 and the connection region 634 is substantially the same as the connection region 644.

Referring now to FIGS. 20A, 20B, and 20C, the connection region 634 is spaced apart from, and overlapping with the connection region 644 to form a gap 660. The gap 660 provides clearance to allow the first leg portion 604 to deflect relative to the second leg portion 612. The connection legs 648 may be connected to the connection region 634 with a weld 664 (e.g., a contact weld or another suitable type of weld). A standoff, bump, etc., may be included on the connection region 634 and/or the connection region 644 to space apart the connection region 634 from the connection region 644. The connection region 634 and the connection region 644 form the connection portion 608.

The connection legs 648 flexibly couple the first leg portion 604 to the second leg portion 612. Because the connection legs 648 have a cumulative width which is less than the width of the first leg portion 604, and because the connection legs 648 are connected to the connection region 634 only by welds 664, the armature 500 is less stiff than an armature such as the armature 224 of FIG. 15. On the other hand, the cumulative cross sectional area through which magnetic flux may pass through the welds 664 is less than the cross sectional area of the first leg portion 604. Alone, this would tend to reduce the maximum magnetic flux that can pass through the armature 600.

The overlap, however, between the connection region 634 and the overlap region 644 provides an additional path through which magnetic flux may pass. This tends to compensate for the reduced cross sectional area of the welds 664. Thus, the maximum deflection of the armature 600 is increased as compared to an armature such as the armature 224 of FIG. 15.

As merely one example, the cumulative width of the connection legs 648 may be 5% to 50% of the width of the first leg portion 604, for example. Additionally, the width of the first leg portion 604 may be 30% to 90% of the width of the connection portion 608, for example.

Additionally, the width of the second leg portion 612 may be greater than the width of the connection portion 608. Further, a width of a portion of the second leg portion 612 may be at least the width of the connection portion 608, while a width of another portion of the second leg portion 612 may be greater than or less than the width of the connection portion 608. Still further, the width of the connection region 634 and/or the second leg portion 612 may be greater than the width of the connection region 644. Additionally, the thickness of the second leg portion 612 may be greater than or less than the thickness of the first leg portion 604.

While the invention is susceptible to various modifications and alternative constructions, certain illustrative embodiments thereof have been shown in the drawings and are described in detail herein. It should be understood, however, that there is no intention to limit the disclosure to the specific forms disclosed, but on the contrary, the intention is to cover all modifications, alternative constructions and equivalents falling within the spirit and scope of the disclosure as defined by the appended claims.

What is claimed is:

1. An armature for a receiver, comprising:

a first leg portion having a thickness and a width, the first leg portion configured to be disposed generally within an electrical coil of the receiver and generally between a plurality of magnets of the receiver;

a second leg portion spaced apart from the first leg portion;

a connection portion to flexibly couple the first leg portion with the second leg portion, wherein the connection portion includes a reduced non-zero thickness portion having a thickness less than the thickness of the first leg portion, and wherein a width of the connection portion is greater than the width of the first leg portion;

the first leg portion being configured and operable to move with respect to the second leg portion in the presence of a magnetic flux created by the plurality of the magnets and the electrical coil.

2. An armature as defined in claim 1, wherein at least a portion of the first leg portion is at an angle to at least a portion of the connection portion.

3. An armature as defined in claim 1, wherein the connection portion is integral with the first leg portion and the second leg portion.

4. An armature as defined in claim 1, wherein the second leg portion comprises a first sub-leg and a second sub-leg, the first sub-leg spaced apart from the second sub-leg.

5. An armature as defined in claim 4, wherein a width of the first sub-leg is substantially the same as the width of the connection portion and wherein a width of the second sub-leg substantially the same as the width of the connection portion.

6. A receiver, comprising:

a housing;

a diaphragm located within the housing;

an armature located within the housing, wherein the armature comprises:

a first leg portion having a thickness and a width wherein the first leg portion is connected to the diaphragm;

a second leg portion spaced apart from the first leg portion; and a connection portion to flexibly couple the first leg portion with the second leg portion, wherein the connection portion includes a reduced non-zero thickness portion having a thickness less than the thickness of the first leg portion, and wherein a width of the connection portion is greater than the width of the first leg portion;

a magnet located within the housing proximate to the armature; and a coil, wherein a portion of the armature extends within the coil.

7. A receiver, comprising:

a plurality of magnets;

an armature located between the plurality of magnets, the armature comprising:

a first leg portion having a thickness and a width;

a second leg portion spaced apart from the first leg portion; and a connection portion to flexibly couple the first leg portion with the second leg portion, wherein the connection portion includes a reduced non-zero thickness portion having a thickness less than the thickness of the first leg portion, and wherein a width of the connection portion is greater than the width of the first leg portion; and a coil, wherein a portion of the armature extends within the coil.

* * * * *

UNITED STATES PATENT AND TRADEMARK OFFICE

CERTIFICATE OF CORRECTION

PATENT NO. : 7,817,815 B2
APPLICATION NO. : 10/758441
DATED : October 19, 2010
INVENTOR(S) : Thomas E. Miller It is certified that error appears in the above-identified patent and that said Letters Patent is hereby corrected as shown below:

ON THE COVER PAGE:
In the section (63) entitled "Related U.S. Application Data", after "May 8, 2011, now abandoned" insert --, which claims the benefit of U.S. Provisional Application No. 60/202,957 filed May 9, 2000, and U.S. Provisional Application No. 60/218,996 filed July 17, 2000.--

Signed and Sealed this
Twenty-second Day of November, 2011

David J. Kappos

David J. Kappos
*Director of the United States Patent and Trademark Office*